United States Patent [19]

Schuster

[11] Patent Number: 4,972,991

[45] Date of Patent: Nov. 27, 1990

[54] HANDLE FOR ARTICLE CARRIER

[75] Inventor: Richard L. Schuster, Monroe, La.

[73] Assignee: Manville Corporation, Denver, Colo.

[21] Appl. No.: 490,870

[22] Filed: Mar. 9, 1990

[51] Int. Cl.[5] ..... B65D 5/46

[52] U.S. Cl. ..... 229/117.13; 206/427

[58] Field of Search ..... 229/40, 117.13; 206/141, 427

[56] References Cited

U.S. PATENT DOCUMENTS

| | | | |
|---|---|---|---|
| 3,593,849 | 7/1971 | Helms | 206/427 |
| 4,405,078 | 9/1983 | Dutcher et al. | 229/117.13 |
| 4,558,816 | 12/1985 | Wood | 229/117.13 |
| 4,653,686 | 3/1987 | Wood et al. | 229/117.13 |
| 4,684,059 | 8/1987 | Rusnock | 229/117.13 |
| 4,728,026 | 3/1988 | Schuster | 229/117.13 |
| 4,784,316 | 11/1988 | Crouch | 229/117.13 |
| 4,838,479 | 6/1989 | Wood | 229/117.13 |

*Primary Examiner*—Gary E. Elkins
*Attorney, Agent, or Firm*—John D. Lister

[57] ABSTRACT

A handle for a sleeve-type carrier. The handle comprises an opening extending transversely of the length of the carrier, the opening being defined by elongated edges and short end edges located in the top panel. Flaps covering the handle opening are connected to the elongated edges along fold lines. An enclosed area extending from each end of the opening into the nearest side panel is defined by a periphery comprised of an interrupted slit, enabling varying concentrations of stresses resulting from lifting the carrier from either edge of the handle opening to be transferred from the ends of the handle opening to the sides of the carrier through the interrupted slits.

15 Claims, 2 Drawing Sheets

HANDLE FOR ARTICLE CARRIER

FIELD OF THE INVENTION

This invention relates to an article carrier, and more particularly to an improved handle for a sleeve-type article carrier.

BACKGROUND OF THE INVENTION

Sleeve-type carriers are commonly used to package beverage cans and other types of articles, and are typically formed from paperboard blanks which have been folded into sleeve form. Each sleeve is opened by a packaging machine, after which cans or other articles are introduced and the end panels are folded and secured together. The resulting carrier normally has a handle incorporated into the top panel to allow a user to more readily lift and carry it.

Many different handle designs for sleeve-type carriers have come into use over the years. The so-called suitcase type of handle is one, comprising two handle openings in the top panel extending lengthwise of the carrier and being spaced transversely from each other so that the top panel portion between them forms a strap. The carrier is lifted by inserting the fingers in one of the openings and lifting up on the strap portion. Because the edges of the strap are often uncomfortable to the hand of the user, particularly if the package is carried for any length of time, and because the concentration of lifting stresses at the ends of the strap often requires the use of relatively thick paperboard to prevent tearing at these locations, suitcase type handles have been replaced in many cases by transversely extending handles.

A transversely extending carrier handle comprises a transverse opening in the top panel of the carrier through which the fingers of a user are inserted. By then lifting up on the underside of the top panel the package can be lifted and carried quite comfortably. Provision has had to be made, however, for the distribution of lifting stresses in order to guard against tearing at the ends of the handle opening without resorting to the use of thicker paperboard.

To combat the tendency to tear, one type of design incorporates a slit that extends from each end of the handle opening into the adjacent side panel of the carrier. The purpose of the slit is to transfer the lifting stresses from the ends of the handle, where tearing is most likely to occur, to the side panels of the carrier, where they can more readily be absorbed by a relatively large expanse of paperboard.

Heavy loads, for example the weight of twelve beverage cans as opposed to six beverage cans, have pointed up the need for better stress distribution. It has been suggested to include a series of fold lines connecting the ends of the slits to the top panel to transfer lifting stresses back to the top panel. Even this design, however, permits more concentration of lifting stresses adjacent the ends of the transverse slit than desired, and sometimes results in the top panel being pulled up too abruptly when lifted. Other designs making use of additional fold lines in the top panel have been proposed in order to improve stress distribution. These designs, although successful in performance, add to the complexity of the carrier.

In order to provide the necessary lifting stress distribution while simplifying the handle design, it was further suggested to extend the handle opening itself into the side panels of the carrier, with much of the handle opening in the top panel being covered by flaps foldably connected to the handle edges. Lifting stresses were distributed along the arcuate end edges of the handle openings in the side panels. Gaps at the ends of the opening in the top panel provided a quick visual guide to the user as to the location of the handle opening and the manner in which it should be used, and also aided esthetically by providing visual continuity with the handle openings in the upper portion of the side panels. In addition, the narrower free edges of the flaps provided less resistance to movement of the flap past tightly packed underlying cans. Disadvantages of the design, however, are that the gaps do not provide for overall continuity of the colors or other parts of the package graphics and they do not provide for a dust-free environment inside the package. Although the entry of dust or other particles into the interior of a carrier does not affect the contents of the articles within the carrier, its existence does not suggest the image to the consumer that most manufacturers want to present.

It would be desirable to overcome the disadvantages of the latter design without destroying its stress distribution advantages.

BRIEF SUMMARY OF THE INVENTION

The invention is carried out by providing an elongated opening in the top panel of an article carrier so that the opening extends transversely of the length of the carrier. The opening is comprised of two spaced elongated edges, each edge being foldably connected to a flap which covers a portion of the handle opening. The ends of the opening terminate in the top panel, and the ends of the flaps terminate adjacent an associated end of the handle opening. In addition, each end of the handle opening is associated with an enclosed area defined by a weakened periphery which extends from an end of the opening through the nearest fold and into the nearest side panel, the portion of the weakened periphery in the side panel comprising an arcuate portion. With this arrangement, the carrier can be lifted by either elongated edge of the handle opening and the resulting stresses will be transferred to the weakened peripheries of the adjacent enclosed areas, thereby avoiding tearing at the ends of the handle opening.

Preferably, the weakened peripheries of the enclosed areas are formed by slits which are interrupted by imperforate portions, one or more of which are designed to tear in response to the stresses of lifting. Also, the spaced edges of the handle opening are preferably parallel, with the interrupted slits in the top panel being an extension of the edges. In addition, the handle opening flaps preferably meet intermediate the handle opening, and the side ends of the flaps are adjacent an enclosed area so as to completely cover the handle opening. By this arrangement lifting stresses are distributed to the side panels of the carrier without tearing the paperboard construction and without having to incorporate a system of fold lines, and the top and side panels are fully enclosed prior to use.

The above and other aspects of the invention, as well as other benefits, will readily be apparent from the more detailed description of the preferred embodiment of the invention which follows.

DETAILED DESCRIPTION OF THE PREFERRED EMBODIMENT

Figure 1:
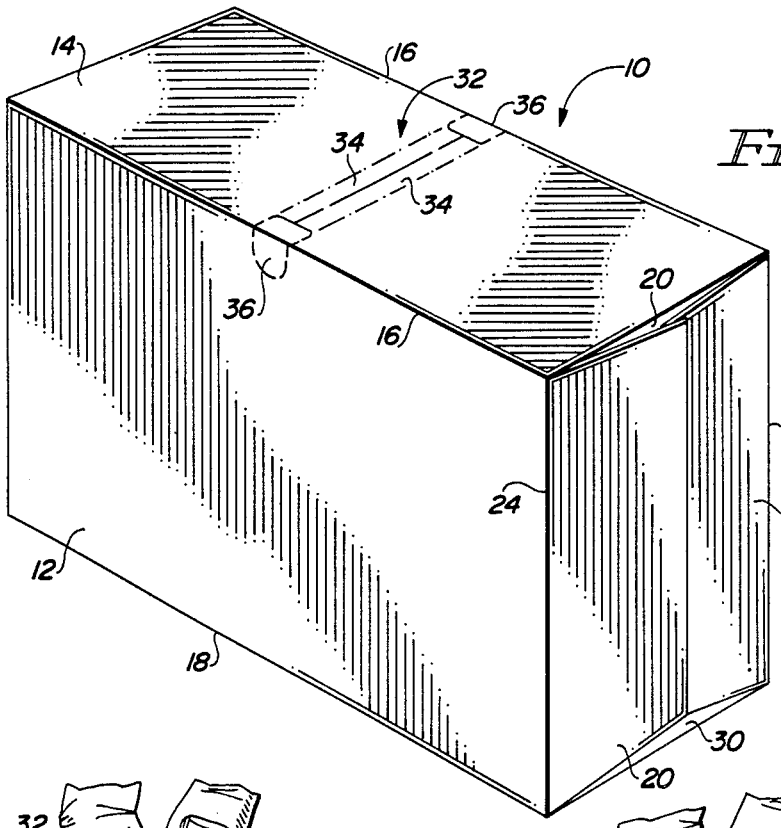
FIG. 1 is a pictorial representation of a preferred embodiment of the sleeve-type carrier of the present invention, as it would appear prior to being lifted by its handle.

Referring to FIG. 1, the carrier 10 comprises side panels 12 connected to the top panel 14 by folds 16 and to the bottom panel, not visible in this view, by folds 18. The end panel shown is comprised of flaps 20 and 22 connected to the side panels by folds 24 and 26, respectively. The end flaps 20 and 22 are adhered by suitable adhesive to dust flaps 28 and 30, only the upper and lower edge portions of which are visible. A similar end panel arrangement is provided at the other end of the carrier. In addition to the above structure, a handle opening 32 is incorporated in the top panel 14. The opening, which is covered by flaps 34, is preferably located midway between the end panels and extends transversely of the side panels. The opening terminates in the top panel 14 adjacent areas 36 the peripheries of which include the ends of the handle openings and extend into the upper portions of the side panels 12. As explained in more detail hereinafter in connection with FIG. 3, the peripheries of the areas 36 are only weakly connected to the top and side panels.

Figure 2:
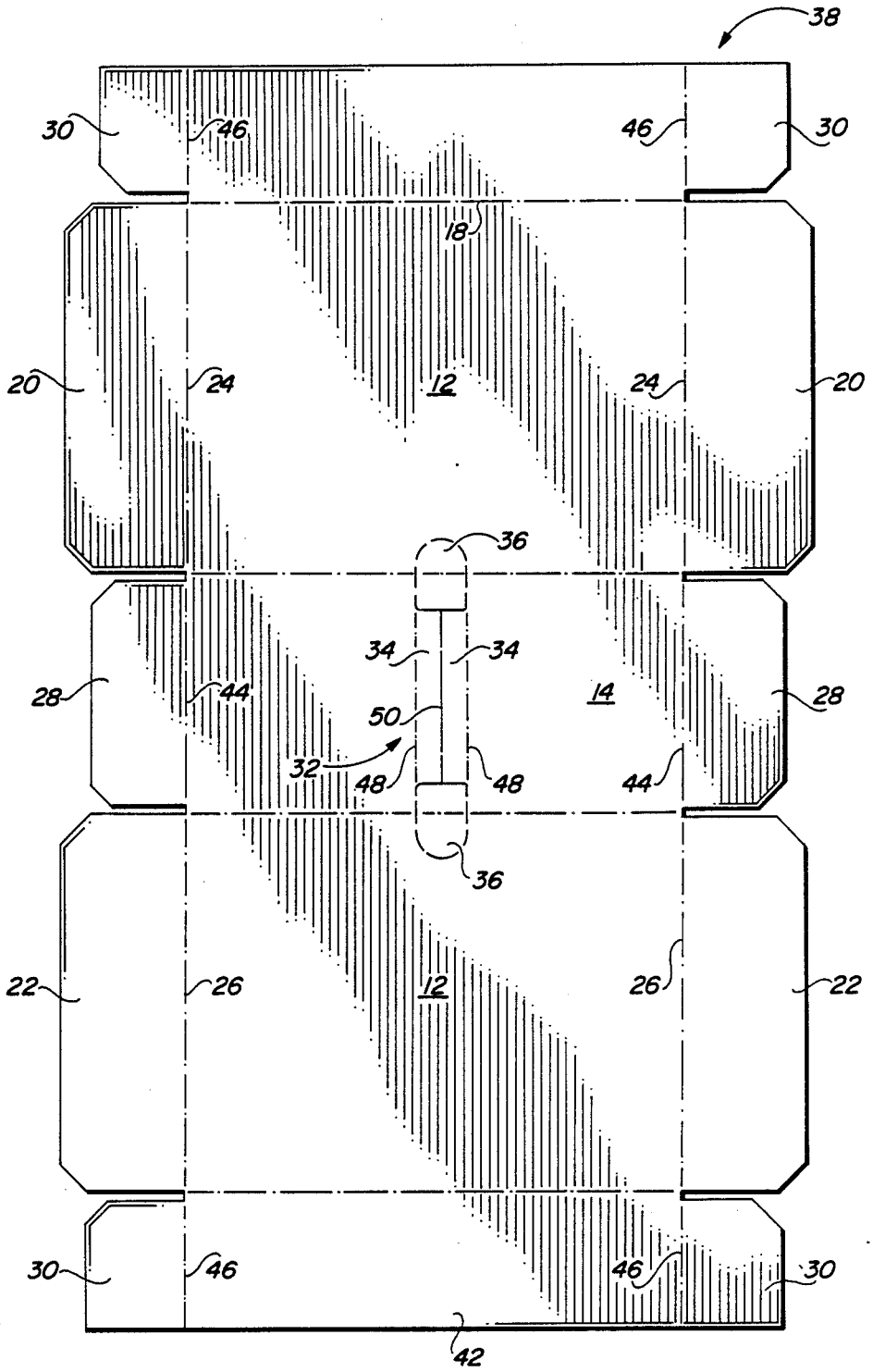
FIG. 2 is a plan view of a production blank for forming the carrier of FIG. 1.

A production blank used to form the carrier of FIG. 1 is indicated generally by reference numeral 38 in FIG. 2. The blank 38 is comprised of a central top panel section 14 connected to intermediate side panel sections 12 by score lines 16. Connected to side panel sections 12 by score lines 18 are end bottom flap sections 40 and 42 which are dimensioned so that portions of them are overlapped when the blank is folded along score lines 16 and 18. The overlapped portions are glued together to form the bottom panel of the carrier 10.

Flaps 20 and 22 are connected to the side panel sections 12 by score lines 24 and 26, respectively, enabling the flaps to be folded toward each other to form the end panels of the carrier. Dust flaps 28, connected to the top panel section 14 by score lines 44, are adapted to be folded prior to the end flaps 20 and 22 being folded toward each other in order to act as a support against which the flaps 20 and 22 are glued. Similarly, dust flaps 30, connected to end flap sections 40 and 42 by score lines 46, are adapted to be folded prior to the folding of the end flaps to also act as a support for the flaps 20 and 22. The blank described thus far is illustrative of conventional designs capable of being formed into functional carriers.

Figure 3:
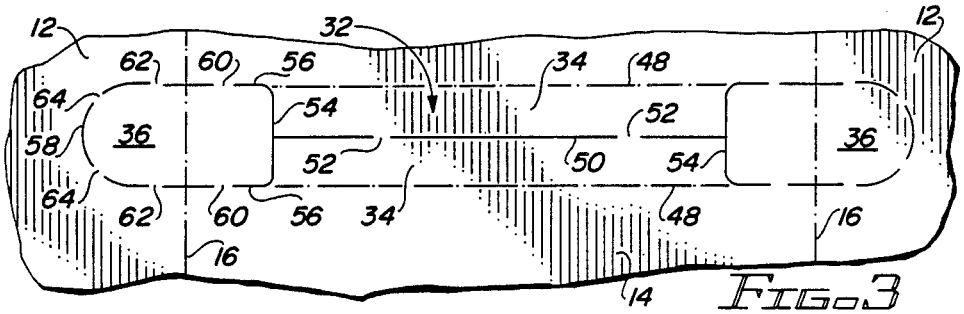
FIG. 3 is an enlarged plan view of the handle of the present invention.

Referring now to FIG. 3 as well as FIG. 2, the handle opening flaps 34 are foldably connected to the top panel along the spaced parallel elongated edges 48 of the opening 32. The opposite or free edges of the flaps 34 meet in the center of the handle opening along slit 50. Preferably the edges are connected together in the blank by widely spaced sections of uncut paperboard 52 which can readily be broken or torn by the user when his or her fingers are inserted into the handle opening of a carrier formed from the blank.

The flaps 34 terminate at their side ends in straight edges corresponding to slits 54 which extend at right angles from the slit 50 to the fold line 48. The slits 54 also correspond to the lateral extent of the handle opening 32. The handle opening is thus defined by the fold lines 48 of flaps 34 and the slits 54. Extending from the ends of the fold lines 48 are skip-cut lines 56 which cross the score lines 16 into the upper portions of the side panels 12 and connect with an arcuate skip-cut line 58. The skip-cut lines comprise slits which are interrupted by spaced narrow imperforate portions of paperboard represented in the top panel by connecting sections 60, in the straight portions of the side panels by connecting sections 62 and in the arcuate portions in the side panels by connecting sections 64. The area 36 enclosed by the interrupted slits and the slit 54 is thus an area the periphery of which is only weakly attached to the surrounding paperboard.

Figure 4:
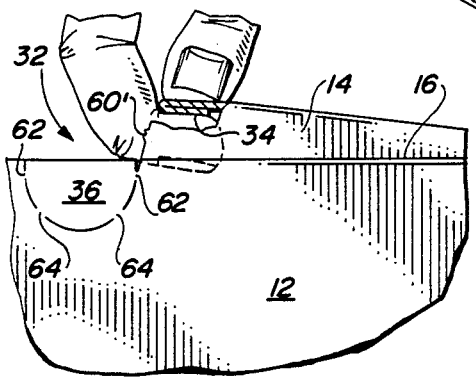
FIG. 4 is an enlarged partial side view of the carrier of FIG. 1, illustrating the upward bowing of the top panel and the distortion of the weakened periphery adjacent the handle opening during lifting.

To lift the carrier a user may approach it from either end, pressing the fingers down against the handle opening flaps 34 to break the imperforate connecting portions 52 holding the flaps together. Continued downward pressure causes the flaps to fold down about their fold lines 48. At that point the user will lift up, as illustrated in FIG. 4, causing the flap 34 contacting the pads of the fingers to be folded up against the underside of the top panel 14 and the adjacent top panel portion to be bowed up as the lifting continues. The lifting stresses will tend to concentrate at the ends of the handle opening edge engaged by the hand of the user and, unless provision were made to distribute the stresses, would tend to tear the paperboard at that point.

The lifting stresses in the present arrangement will be distributed along the adjacent skip-cut lines 56 in the top panel 14. This would cause the slit extending from the end of the flap 34 to the first imperforate section 60 to be distorted upwardly as the lifting stresses are distributed into the top and the side panels. If the lifting stresses are too great to be halted at the imperforate sections 60, the stresses will cause the imperforate sections 60 to tear, allowing the distribution of stresses to take place all the way down to the imperforate sections 62 in the side panels 12. This is the state of stress distribution illustrated in FIG. 4, wherein the edge 60' of the torn imperforate section 60 is shown. The bowed condition of the elongated edge at the right side of the handle opening causes the folds 16 to be distorted inwardly in the region of the handle opening, pulling the upper portions of the adjacent side panels 12 inwardly also. The smooth uniform upward bowing of the top panel indicates a uniform distribution of the lifting stresses, avoiding a concentration of stresses in any one area and thus avoiding tearing of the paperboard.

Figure 5:
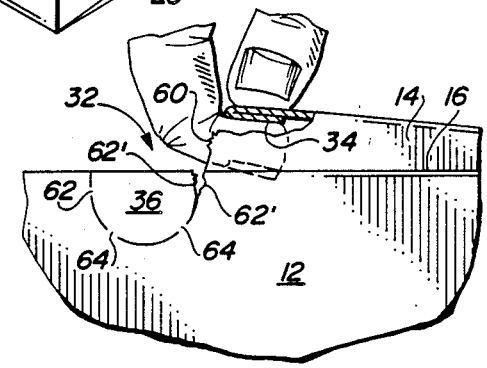
FIG. 5 is an enlarged partial side view similar to that of FIG. 4, but showing the further distortion of the weakened periphery when subjected to greater lifting stresses.

If the carrier load is still too great to allow stress distribution to stop at that point, the next imperforate sections 62 will be torn or broken, distorting the handle attachment still more, as illustrated in FIG. 5. The edges 62' indicate the torn imperforate section 62. Although the lifting action has been explained as if both ends of the handle are receiving similar amounts of lifting stress, causing corresponding imperforate sections at both ends of the handle to be torn or broken apart, it is possible that more stress may be applied to one side or the other of the carrier when lifting it, as when the hand of the user is off-center, which could cause more imperforate sections at one end of the handle to be broken than at the other end. This is beneficial since the construction of the handle thus provides for the amount of stress distribution needed under the circumstances.

Although it is normally unlikely that lifting stresses would cause more than the imperforate sections 60 and 62 to be broken, the imperforate sections 64 could also be broken in order to take up excessive stresses without tearing. This would transmit the stresses into the arcuate portion 58 of the skip-cut line which would effectively prevent tearing of the paperboard. It will be noted from FIG. 3 that slit portions of the skip-cut lines intersect the folds 16 rather than imperforate portions. This is a preferred arrangement in order to ensure the distribution of lifting stresses along the skip-cut line rather than having them concentrate at the fold lines and possibly run the risk of tearing along the fold lines.

Although the handle opening flaps have been described as being separated from the enclosed area 36 by slits 54, it is possible, if desired, to employ skip-cut lines instead of the slits 54. In such an arrangement the flaps would still be pushed down by the fingers of a user after pressure from the fingers would have broken the imperforate sections of the skip- C cut lines. It has not been found necessary to employ such a design in view of the skip-cut lines at the adjacent flap edges and at the perimeter of the enclosed areas 36 which hold these elements in place without the need for further imperforate sections at the slits 54.

It should now be apparent that the carrier of the present invention not only is more convenient to lift due to the arrangement of the single transverse handle opening and the manner in which the top panel distorts to permit easy finger access into the opening, but is also more economical to produce. Whereas thicker stock is required to provide adequate strength in prior art sleeve-type carriers, thinner stock can be used to produce the carrier of this invention. Moreover, the stresses can be distributed along a path which is present in the carrier but is hidden by the inclusion of the enclosed area 66 within the confines of the path. This prevents the entry of dust or other particles into the carrier and also provides a smooth uninterrupted carrier surface so that a uniform color scheme or graphics presentation may be provided.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. In an article carrier having a top panel connected to side panels by folds extending along the length of the carrier, a handle comprising:

an elongated opening in the top panel extending transversely of the length of the carrier, the opening having ends terminating in the top panel;

each end of the handle opening comprising a portion of the periphery of an enclosed area incorporating adjacent portions of the top and side panels, the periphery of the enclosed area being further defined by weakened portions extending from said handle opening end through the nearest fold and into the nearest side panel; and said weakened portions of the periphery comprising an arcuate portion in said nearest side panel;

whereby stresses at the ends of the handle opening resulting from the carrier being lifted by either of the spaced edges of the handle opening are transferred to the carrier through the weakened portions of the peripheries of the adjacent enclosed areas.

2. The carrier handle of claim 1, wherein the weakened portions of the peripheries comprise slits interrupted by imperforate portions.

3. The carrier handle of claim 2, wherein the weakened portions of the periphery intersecting the folds connecting the top panel to the side panels comprise slits.

4. The carrier handle of claim 2, wherein each weakened portion in the top panel includes at least one imperforate portion.

5. The carrier handle of claim 2, wherein the interrupted slits in the side panels are connected by an interrupted slit forming the arcuate portion of the enclosed area in said side panel.

6. The carrier handle of claim 5, wherein each interrupted slit in the side panels contains at least one imperforate portion, and wherein each arcuate interrupted slit contains at least one imperforate portion.

7. The carrier handle of claim 1, wherein the elongated opening comprises two spaced elongated edges, each edge being foldably connected to a flap covering a portion of the handle opening, each flap having side ends terminating adjacent an associated end of the handle opening.

8. The carrier handle of claim 7, wherein the flaps meet substantially midway between the spaced elongated edges of the handle opening and wherein the side ends of each flap are substantially perpendicular to the spaced elongated edges of the handle opening.

9. The carrier handle of claim 8, wherein the weakened portions in the top panel are aligned with the foldable connections of the flaps.

10. The carrier handle of claim 9, wherein the weakened portion forming the arcuate portion of each enclosed area is connected to interrupted slits in the top panel by interrupted slits in the side panels.

11. The carrier handle of claim 10, wherein the two spaced edges of the handle opening are substantially parallel, and wherein the distance between opposite segments of interrupted slits in the top panel is substantially equal to the distance between the spaced edges of the handle opening.

12. In a blank for forming an article carrier, the blank having a top panel section connected to side panel sections by fold lines, a handle comprising:

an elongated opening in the top panel section extending transversely of the fold lines, the opening having ends terminating in the top panel section;

the elongated opening comprising two spaced elongated edges, each edge being foldably connected to a flap covering a portion of the handle opening;

each flap having side ends terminating adjacent an associated end of the handle opening; and each end of the handle opening comprising a portion of the periphery of an enclosed area incorporating adjacent portions of the top and side panel sections, the periphery of the enclosed area being further defined by weakened portions extending from said handle opening end through the nearest fold line and into the nearest side panel section;

said weakened portions of the periphery in the side panel sections being connected by an arcuate portion in said nearest side panel section;

whereby stresses at the ends of the handle opening of the carrier resulting from the carrier being lifted by either of the spaced edges of the handle opening are transferred to the side panels of the carrier through the weakened portions of the peripheries of the adjacent enclosed areas.

13. The blank of claim 12, wherein the weakened portions of the peripheries comprise slits interrupted by imperforate portions.

14. The blank of claim 13, wherein the interrupted slit forming the arcuate portion of each enclosed area is connected to interrupted slits in the top panel section by segments of interrupted slits in the side panel sections.

15. The blank of claim 14, wherein the two spaced edges of the handle opening are substantially parallel, and wherein the distance between opposite segments of interrupted slits in the top panel section is substantially equal to the distance between the spaced edges of the handle opening.

* * * * *